US006718655B2

(12) United States Patent
Sugawara

(10) Patent No.: US 6,718,655 B2
(45) Date of Patent: Apr. 13, 2004

(54) FOOTWEAR BOTTOM

(76) Inventor: Fumio Sugawara, 65, Aza-Machiura, Senmaya, Senmayacho, Higashi-Iwai-Ken, Iwate-Gun (JP)

( * ) Notice: Subject to any disclaimer, the term of this patent is extended or adjusted under 35 U.S.C. 154(b) by 0 days.

(21) Appl. No.: 10/137,294

(22) Filed: May 3, 2002

(65) Prior Publication Data

US 2002/0184792 A1 Dec. 12, 2002

(30) Foreign Application Priority Data

May 7, 2001 (JP) ..... 2001-135940
Mar. 26, 2002 (JP) ..... 2002-085764

(51) Int. Cl.[7] ..... A43B 13/28; A43B 13/18; A43B 23/00; A43B 21/30; F16F 1/18

(52) U.S. Cl. ..... 36/28; 36/103; 36/107; 36/38; 36/27; 267/158; 267/160

(58) Field of Search ..... 36/85, 102, 103, 36/107, 114, 117.5, 27, 28, 30 R, 38, 151, 158, 168, 179; 267/158, 160, 48, 52, 260

(56) References Cited

U.S. PATENT DOCUMENTS 1,317,021 A * 9/1919 Keys ..... 36/151
4,293,885 A * 10/1981 Shirako et al. ..... 267/158
4,592,153 A * 6/1986 Jacinto ..... 36/38
5,437,110 A * 8/1995 Goldston et al. ..... 36/38
5,596,819 A * 1/1997 Goldston et al. ..... 36/35 R
5,778,560 A * 7/1998 Danieli ..... 36/35 R
5,797,198 A * 8/1998 Pomerantz ..... 36/27
5,822,886 A * 10/1998 Luthi et al. ..... 36/28
6,436,012 B1 * 8/2002 Naville ..... 36/114
6,588,125 B2 * 7/2003 Proctor, Sr. ..... 36/117.1

FOREIGN PATENT DOCUMENTS

| | | |
|---|---|---|
| JP | 9-051803 | 2/1997 |
| JP | 10-066604 | 3/1998 |
| JP | 11-225801 | 8/1999 |
| JP | 2000-175703 | 6/2000 |

* cited by examiner

*Primary Examiner*—Anthony D. Stashick
(74) *Attorney, Agent, or Firm*—Wenderoth, Lind & Ponack, L.L.P.

(57) ABSTRACT

According to the present invention, a cushion-action applying implement comprising a gutter-like receiver, a plate spring in which a flexing portion is inserted into the gutter-like portion, the flexing portion is provided in its both sides with embedded portions in series, and an angle formed by the embedded portions is V or nearly horizontal, a switching shaft provided with a cam for pushing the flexing portion of the plate spring to change the angle formed by the embedded portions and in which an engaging portion for rotation is provided on the end thereof, a bearing of the switching shaft fixedly mounted on both ends of the gutter-like receiver, and a drive means for rotating the switching shaft is embedded in the flexing portion of the footwear bottom body, whereby the switching shaft is rotated to simply switch to the state of presence or the state of absence of cushioning.

5 Claims, 12 Drawing Sheets

FOOTWEAR BOTTOM

BACKGROUND OF THE INVENTION AND PRIOR ART

The present invention relates to a footwear bottom free from feeling of fatigue used for footwears such as Japanese sandals (slippers), sandals, training shoes, shoes for rehabilitation and the like, and a cushion-action applying implement used for the former.

Various devices have been proposed heretofore, in which an elastic substance is embedded in the sole of a shoe, and walking is made easier by the repulsion action thereof.

For example, in Japanese Patent Application Laid-Open No. Hei 10 (1998)-66604 Specification, there are proposed foams comprising synthetic rubber or urethane rubber, air cushion caused by a compression coil spring or a cave-like portion, and a construction in which an elastic substance such as a disc spring or a plate spring is embedded to apply the cushioning to the sole of a shoe, any of which however always have the cushion action and repulsion action.

SUMMARY OF THE INVENTION

It is an object of the present invention to provide a footwear bottom which enables to provide the configuration that at the time of walking, he or she steps forward from the heel, the whole bottom is then placed in contact with the ground, and afterwards, the push-up force is applied to the heel at the time of stepping forward to help movement of weight at the time of advancing, and which enables to assume the state that at the time of normal walking or at the time of putting away, the push-up force is not given, and a cushion-action applying implement used for the footwear bottom.

The present invention has been accomplished in order to solve the aforementioned object. According to a first invention of the invention, there is provided a footwear bottom characterized in that a cushion-action applying implement comprising a gutter-like receiver, a plate spring in which a flexing portion is inserted into the gutter-like portion, the flexing portion is provided in its both sides with embedded portions in series, and an angle formed by the embedded portions is V or nearly horizontal, a switching shaft provided with a cam for pushing the flexing portion of the plate spring to change the angle formed by the embedded portions and in which an engaging portion for rotation is provided on the end thereof, a bearing of the switching shaft fixedly mounted on both ends of the gutter-like receiver, and a drive means for rotating the switching shaft is embedded in the flexing portion of the footwear bottom body.

The embedded portions may be secured to the footwear bottom body, or one or both may be embedded movably.

According to a second invention, there is provided a cushion-action applying implement which is embedded, for use, in a footwear bottom comprising a gutter-like receiver, a plate spring in which a flexing portion is inserted into the gutter-like portion, the flexing portion is provided in its both sides with embedded portions in series, and an angle formed by the embedded portions is V or nearly horizontal, a switching shaft provided with a cam for pushing the flexing portion of the plate spring to change the angle formed by the embedded portions and in which an engaging portion for rotation is provided on the end thereof, a bearing of the switching shaft fixedly mounted on both ends of the gutter-like receiver, and a drive means for rotating the switching shaft.

In the first and second inventions, alternatively, the gutter-like receiver may be formed of metal or synthetic resin, an embedded fixing plate is secured to the outside thereof so that the gutter-like receiver may be secured to the footwear bottom body firmly, and the flexing portion of the plate spring may be of a reversed Ω, or a triangle or a △ shape.

BRIEF DESCRIPTION OF THE DRAWINGS

FIG. 13A-1 is a longitudinal sectional side view showing the state of the normal time.

FIG. 13A-2 is a side view of a cushion-action applying implement in the state of the normal time.

FIG. 13B-1 is a longitudinal sectional side view showing the state before being placed in contact with ground at the time of a cushion-action applying.

FIG. 13B-2 is an enlarged side view in the state before being placed in contact with ground at the time of a cushion-action applying.

FIG. 13C-1 is a longitudinal sectional side view showing the state at the time of starting a walk at the time of a cushion-action applying.

FIG. 13C-2 is an enlarged side view in the state at the time of starting walk at the time of a cushion-action applying.

DESCRIPTION OF THE PREFERRED EMBODIMENTS

First Embodiment

Figure 1:
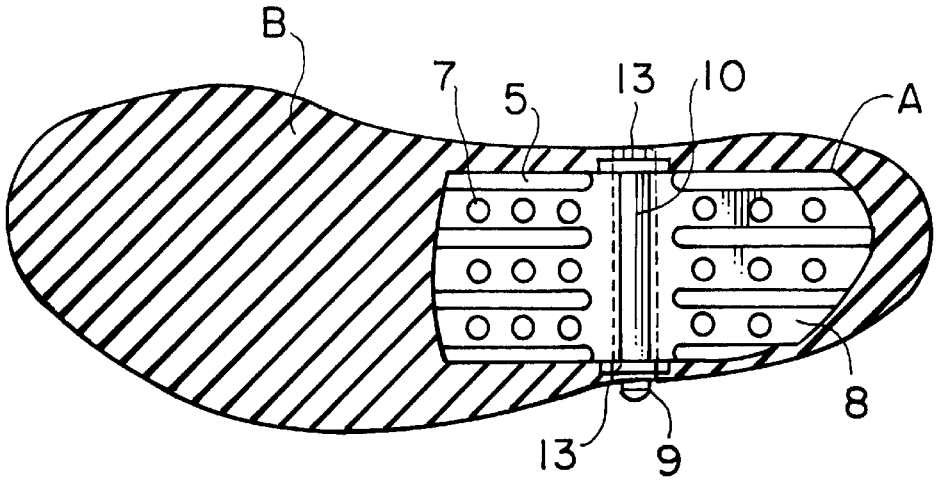
FIG. 1 is a plan view of a first embodiment of the present invention.

FIG. 1 shows a first embodiment of the present invention. Reference character A denotes a cushion-action applying implement, and B denotes the footwear bottom body formed of synthetic rubber.

Figure 2:
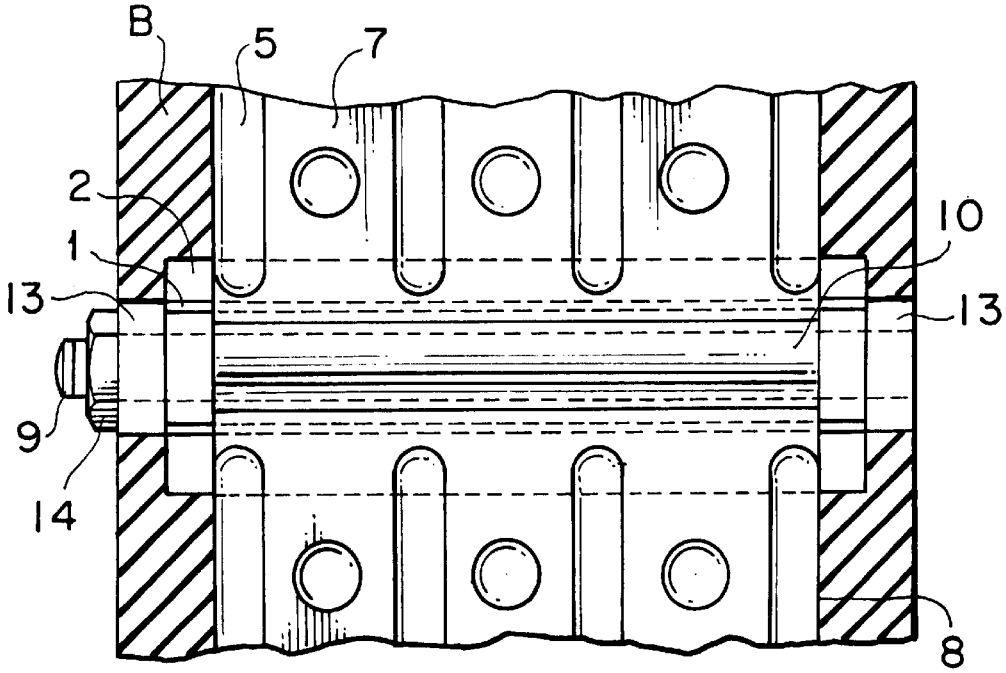
FIG. 2 is an enlarged plan view of a main part of a cushion-action applying implement.
Figure 3:
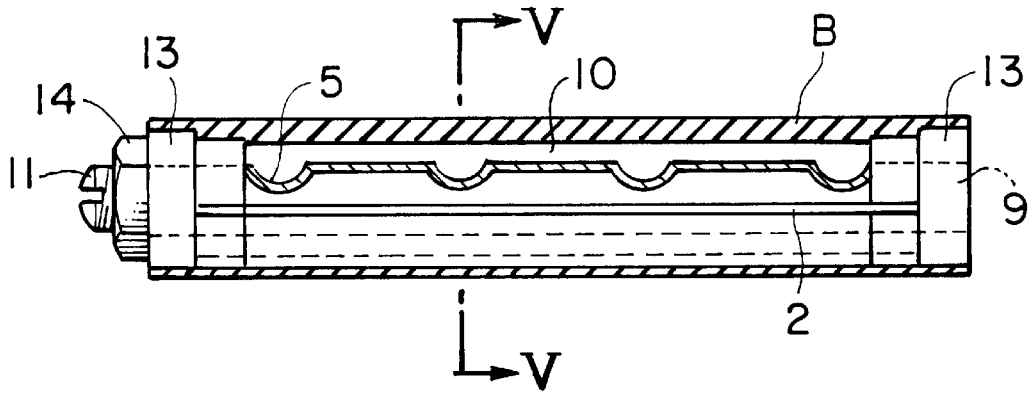
FIG. 3 is an enlarged front view of the same.
Figure 4:
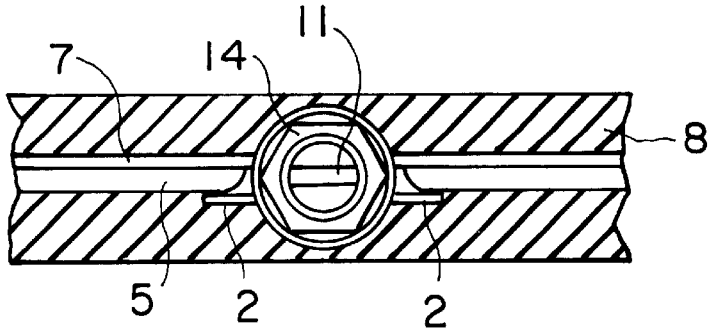
FIG. 4 is an enlarged left side view of the same.
Figure 5:
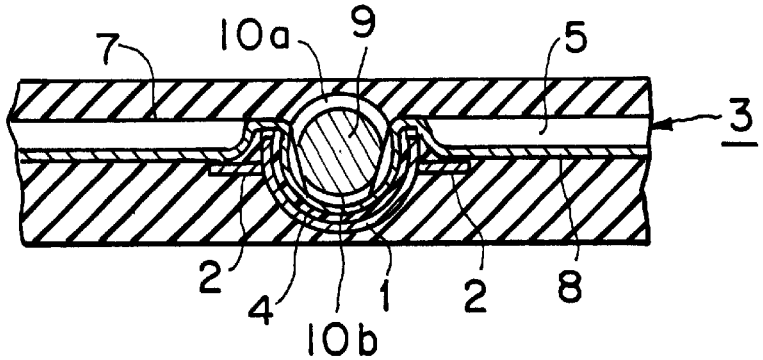
FIG. 5 is a sectional view taken on line V—V of FIG. 3.
Figure 6:
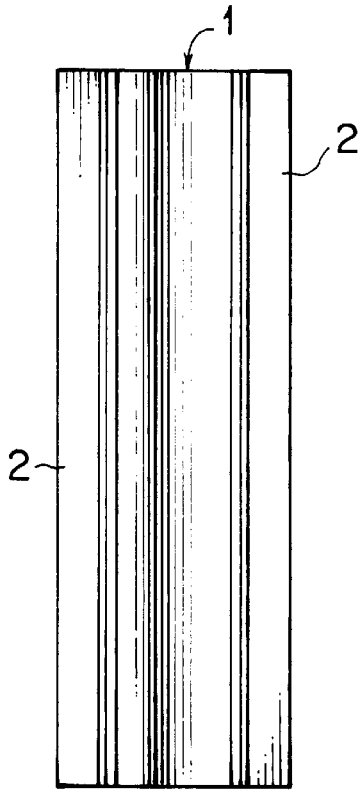
FIG. 6 is an enlarged plan view of a gutter-like receiver.
Figure 8:
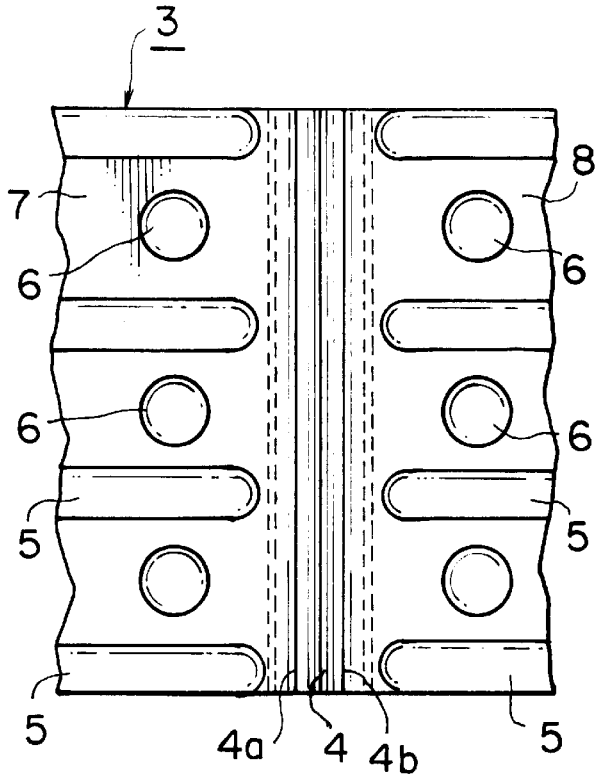
FIG. 8 is an enlarged plan view of a plate spring.
Figure 7:
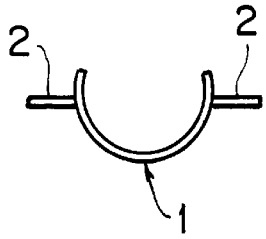
FIG. 7 is an enlarged front view of the same.
Figure 9:
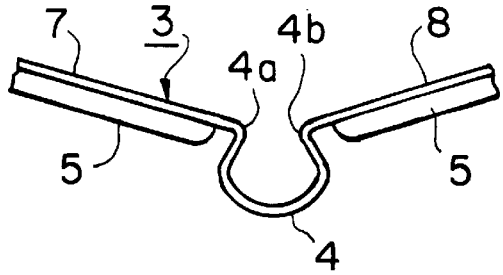
FIG. 9 is an enlarged front view of the same.

FIG. 2 is an enlarged plan view of a main part of the cushion-action applying implement; FIG. 3 is an enlarged front view of the same; FIG. 4 is an enlarged left side view of the same, and FIG. 5 is a sectional view taken on line V—V of FIG. 3. Reference numeral 1 denotes a gutter-like receiver having a C-shaped section provided with embedded fixing plates 2, 2 on the external side as shown in FIGS. 6 and 7, and 3 denotes a plate spring comprising an inverted Ω-shaped flexing portion 4 inserted into the gutter-like receiver 1, and provided in series with an embedded portion 7 provided with a rib 5 and a through-hole 6 on both sides thereof and an embedded portion 8, an angle formed between the embedded portion 7 and the embedded portion 8 being V, as shown in FIGS, 8 and 9, which is a V-shape in the free state as shown in FIG. 9.

Figure 10:
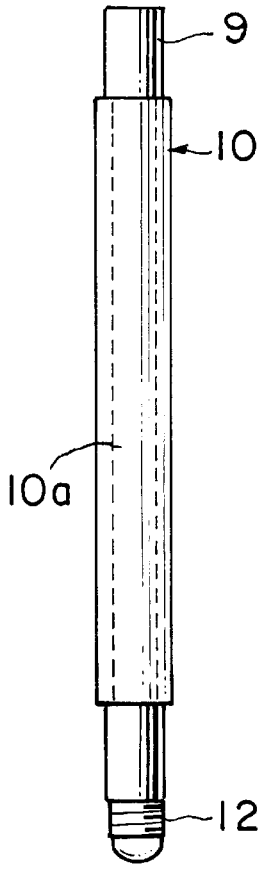
FIG. 10 is an enlarged plan view of a switching shaft.
Figure 12A:
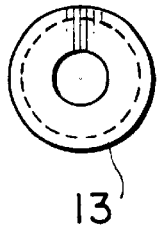
FIG. 12A is an enlarged front view of a bearing.
Figure 12B:
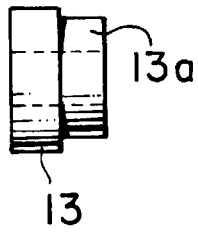
FIG. 12B is an enlarged side view of a bearing.
Figure 11:
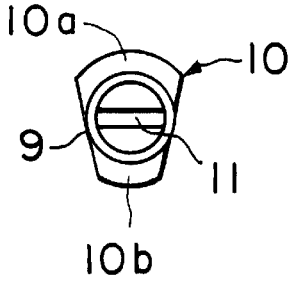
FIG. 11 is an enlarged front view of the same.

Reference numeral 9 denotes a switching shaft comprising a cam 10 having a sector section for pushing both inner edges 4*a*, 4*b* of the inverted Ω-shaped flexing portion 4 of the plate spring 3 to enlarge or reduce between both the inner edges and provided on the end thereof with a rotating engaging portion 11 (a minus groove in the embodiment) and a male thread portion 12, as shown in FIGS. 10 and 11; 13, 13 denote a bearing of the switching shaft provided with a shoulder 13*a* as shown in FIGS. 12A and 12B, and having the shoulder 13*a* fixedly mounted on both ends of the gutter-like receiver 1 by means of solder or welding; and 14 denotes a nut threadedly fitted in the male thread portion 12 of the switching shaft 9.

Figures 1, 13A:
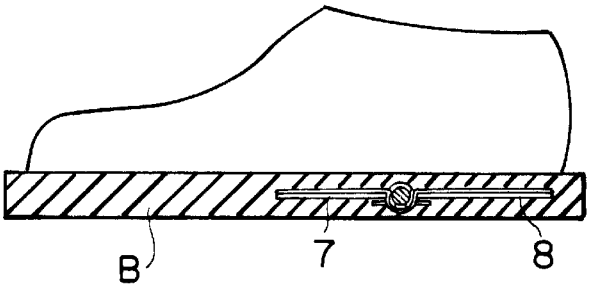
Figures 2, 13A:
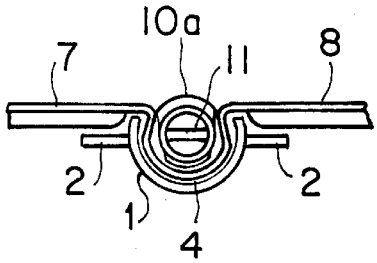

Then, the cushion-action applying implement A is assembled in a manner that first, the flexing portion 4 of the plate spring 3 is inserted from the side into the gutter-like receiver 1, then the switching shaft 9 is inserted from the side into the flexing portion 4. The bearing 13 is put in so as to hold it from both ends of the switching shaft 9. The gutter-like receiver 1 and the bearing 13 are fixed by bonding with an adhesive or solder or welding, and thereafter the nut 14 is threadedly fitted in the male thread portion 12 of the switching shaft 9. At this time, the sector cam 10 assumes the state shown in FIG. 13B-2, and 10*b* on the narrow side of the cam 10 is positioned above, which becomes difficult to embed it into the footwear bottom B when the shoe bottom is manufactured. Therefore, a screw driver or the like is put into the minus groove of a driver engaging portion 11 of the switching shaft 9 to rotate it by 180 degrees so that the wide side 10*a* of the cam 10 assumes the above position as shown in FIG. 13A-2 to enlarge between both the inner edges 4*a* and 4*b* of the flexing portion 4 to make the embedded portion 7 and the embedded portion 8 horizontal. Finally, the nut 14 is fastened to the male thread portion 12 of the switching shaft 9 by means of a wench or the like whereby the cam 10 is secured to the bearing 13 at that position.

The cushion-action applying implement A constituted as described above enables to provide the state of applying or not applying the cushioning to the footwear bottom body B by embedding the embedded portion 7 and the embedded portion 8 on the nail tip side and the heel side, respectively, as shown in FIG. 1 and FIG. 13A-1. It is noted of course that in case of being embedded in the footwear bottom body B, a preventive measure such as coating of a release agent be taken so as to prevent the cam and the rotating portion from sticking to the constituting materials of the footwear bottom, resulting in disablement of rotation.

In the footwear bottom having the present cushion-action applying implement A embedded therein, where the switching shaft 9 is rotated to position the wide side 10*a* above, as shown in FIG. 13A-2, the wide side 10*a* is moved in between both the inner edges 4*a* and 4*b* of the flexing portion 4 to spread between both the inner edges, because of which the footwear bottom body B is planar similarly to the normal footwear bottom. Accordingly, no inconvenience occurs in receiving.

Figures 1, 13B:
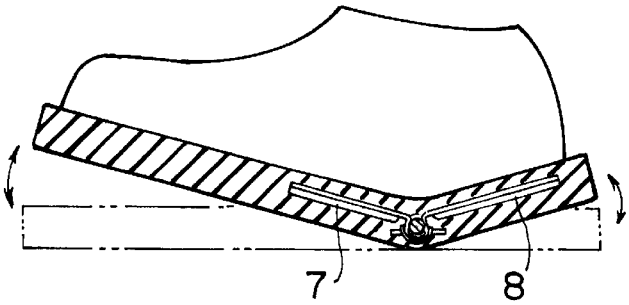
Figures 2, 13B:
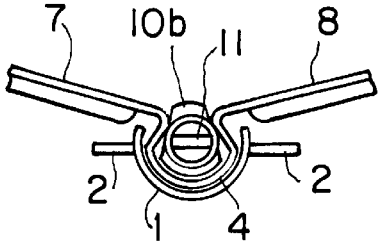
Figures 1, 13C:
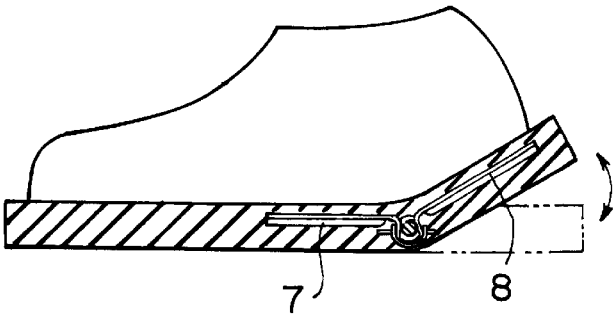
Figures 2, 13C:
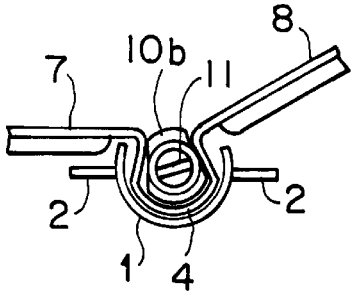

On the other hand, when the switching shaft 9 is rotated to position the narrow portion 10*b* above, the footwear bottom body B assumes a V form as shown in FIG. 13B-2 and FIG. 13C-2, and the cushioning is applied by the plate spring 3. Therefore, when walking with the footwear using the footwear bottom body B worn, movement of the weight from the heel to the toe tips of feet is accelerated by the repulsion action caused by the cushion-action applying implement, making a walk easier in a well balanced manner.

Since the weight is pushed up by the repulsion force caused by the plate spring 3, there can be provided a footwear capable of sufficiently coping with walking for a long period of time without feeling of fatigue of the heel and the Achilles' tendon.

While in the first embodiment described above, one and the other of the embedded portions are embedded in the arch of the foot and heel, respectively, it is noted that they are not limited thereto, but they can be embedded in the flexing portion to which the cushion-action is applied, for example, between the nail tip portion and the arch of the foot.

Further, while in the present embodiment, the drive means for rotating the switching shaft 9 comprises the construction in which the driver engaging portion 11 is provided on the switching shaft 9, and the switching shaft 9 is fastened by the nut 14 so that the former is not rotated carelessly, it is noted that the configuration is not limited to the aforementioned construction.

Second Embodiment

Figure 14:
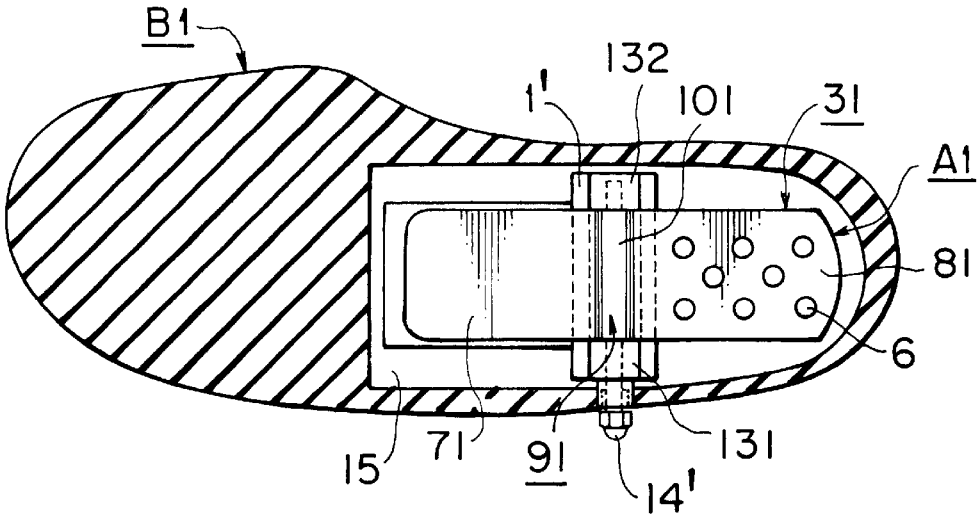
FIG. 14 is a plan view of a second embodiment according to the present invention.

FIG. 14 shows a second embodiment of the present invention. A1 denotes a cushion-action applying implement, and B1 denotes the footwear bottom body formed of synthetic rubber.

Figure 15A:
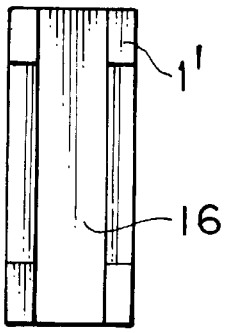
FIG. 15A is an enlarged plan view of a gutter-like receiver.
Figure 15B:
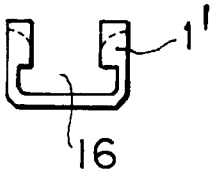
FIG. 15B is an enlarged side view of the gutter-like receiver.
Figure 16A:
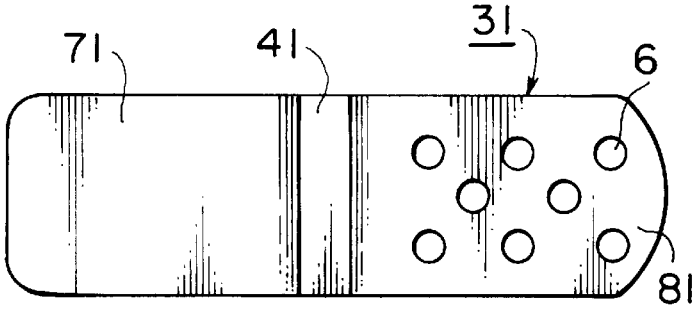
FIG. 16A is an enlarged plan view of a plate spring.
Figure 16B:
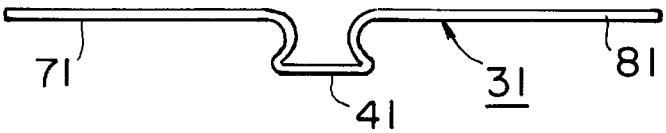
FIG. 16B is an enlarged side view of the plate spring.
Figure 17A:
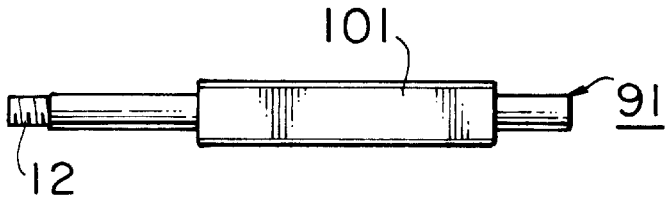
FIG. 17A is an enlarged plan view of a switching shaft.
Figure 17B:
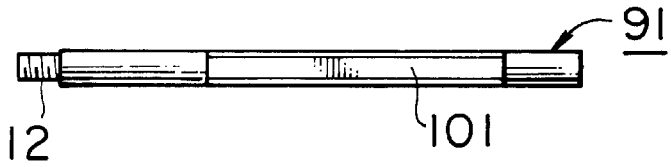
FIG. 17B is an enlarged side view of the switching shaft.
Figure 18A:
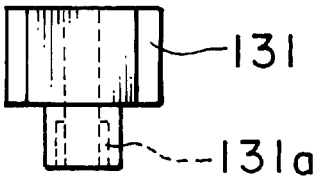
FIG. 18A is an enlarged front view of a bearing.
Figure 18B:
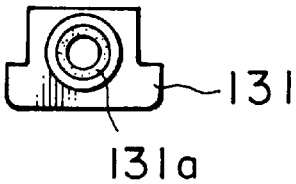
FIG. 18B is an enlarged side view of the bearing.
Figure 19A:
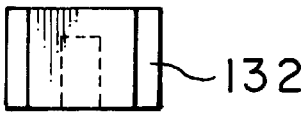
FIG. 19A is an enlarged front view of a bearing.
Figure 19B:
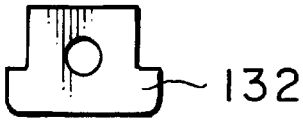
FIG. 19B is an enlarged side view of the bearing.

Numeral 1' denotes a gutter-like receiver made of synthetic resin or metal having a fitting-in groove 16 as shown in FIG. 15, and numeral 31 denotes a plate spring comprising a flexing portion 41 flexed into a triangular shape inserted into the fitting-in groove 16 within the gutter-like receiver 1' and provided in series with an embedded portion 71 and an embedded portion 81 formed with a through-hole 6 on both sides thereof, as shown in FIGS. 16A and 16B, which is a nearly horizontal state as shown in FIG. 16B in a free state.

Numeral 91 denotes a switching shaft comprising a cam 101 having a rectangular section for pressing the bottom side portion of the triangular flexing portion 41 of the plate spring 31 and provided on one end with a male thread portion 12, as shown in FIGS. 17A and 17B, 131 and 132 denote a bearing of the switching shaft 91 fitted in and secured to both ends of the gutter-like receiver 1' by an adhesive, as shown in FIGS. 18A and 18B or FIGS. 19A and 19B, and a water-proofing packing 131*a* made of rubber is provided in an axial hole of the bearing 131. 14' denotes a nut threadedly fitted in the male thread portion 12 of the switching shaft 91.

Then, the cushion-acting applying implement A1 is assembled in a manner that first, the flexing portion 41 of the plate spring 31 is inserted into the gutter-like receiver 1', the switching shaft 91 is inserted into the flexing portion 41, the bearings 131 and 132 are mounted on both ends of the switching shaft 91, after which the gutter-like receiver 1' and the bearings 131 and 132 are fixed by an adhesive, and a box nut 14' is threadedly fitted in the male thread portion 12 of the switching shaft 91 and fixed to the male thread portion 12.

Figure 20A:
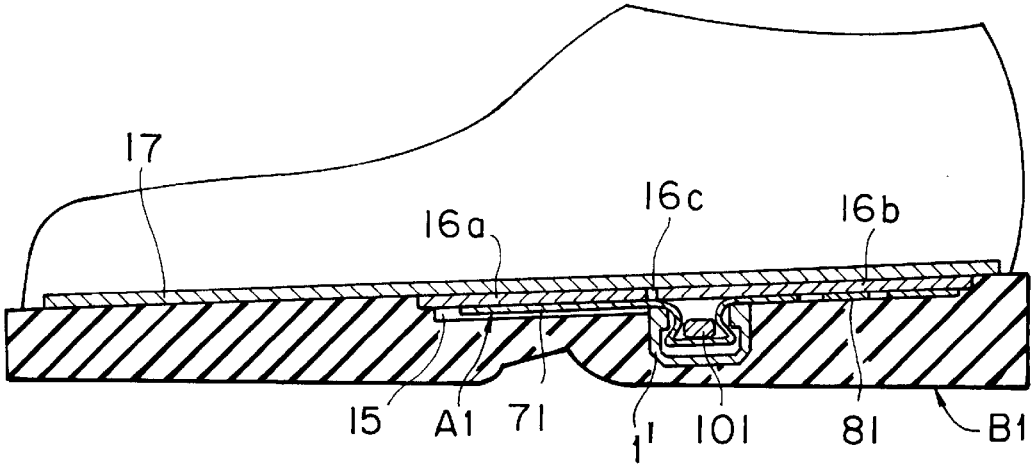
FIG. 20A is a side view at the ordinary time of a second embodiment according to the present invention.

In mounting the cushion-action applying implement A1 on the footwear bottom body B1, the embedded portion 81 is embedded in and secured to the heel of the footwear bottom body B1, and the embedded portion 71 is movably mounted on the shank portion of the footwear bottom body B1. In this embodiment, constitution is made so that as shown in FIG. 20A, a recess 15 is provided in the footwear bottom body B1, a reinforcing cover 16*a* made of hard synthetic resin is bonded to the footwear bottom body B1 to form a cave-like portion, within which the embedded portion 71 moves.

Figure 20B:
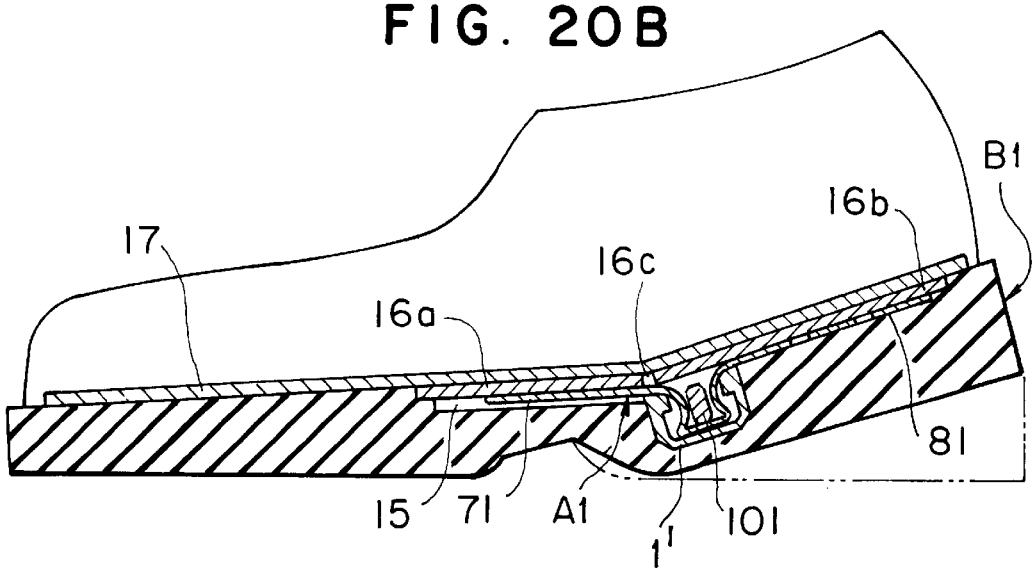
FIG. 20B is a side view when a cushion-action is applied of the second embodiment according to the present invention.

In applying the cushion-action, when the switching shaft 91 is rotated by 90 degrees to place a cam 101 longitudinally, the internal lower surface of the triangular flexing portion 41 supported on the upper edges on both sides of the gutter-like receiver 1' is pressed, and therefore, the embedded portion 71 is pulled into the gutter-like receiver 1', and the whole plate spring 31 assumes a V-state. As a result, the footwear bottom body B1 assumes a V-state as shown in FIG. 20B, and the cushioning is applied by the plate spring 31.

It is noted that in this embodiment, the reinforcing covers 16*a* and 16*b* made of hard synthetic resin having elasticity are provided between an insole 17 and the cushion-action applying implement so that the insole 17 may not rise when the cushioning is applied, and a cut 16*c* is provided at a support point position so that the cushioning may not be impaired.

Third Embodiment

Figure 21A:
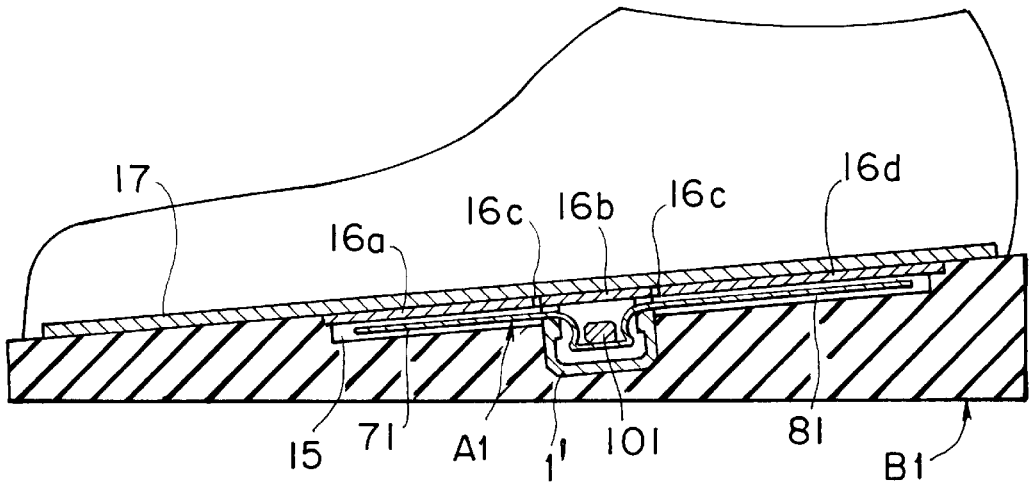
FIG. 21A is a side view at the ordinary time of a third embodiment according to the present invention.
Figure 21B:
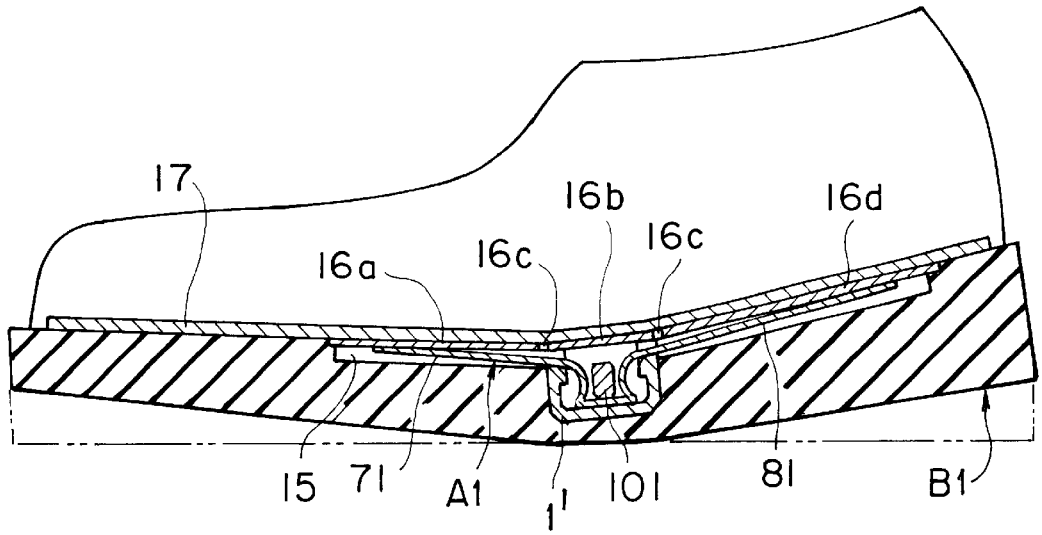
FIG. 21B is a side view when a cushion-action is applied of the third embodiment according to the present invention.

In the second embodiment, the embedded portion 81 is bonded and secured to the footwear bottom. Alternatively, however, both the embedded portion 71 and the embedded portion 81 may be moved in the direction of the gutter-like receiver as in the third embodiment of the present invention shown in FIGS. 21A and 21B. In this case, reinforcing covers 16*a*, 16*b* and 16*d* are provided, and a cut 16*c* may assume a position of a support point so as not to impair the cushioning similarly to that mentioned above.

Fourth Embodiment

Figure 22A:
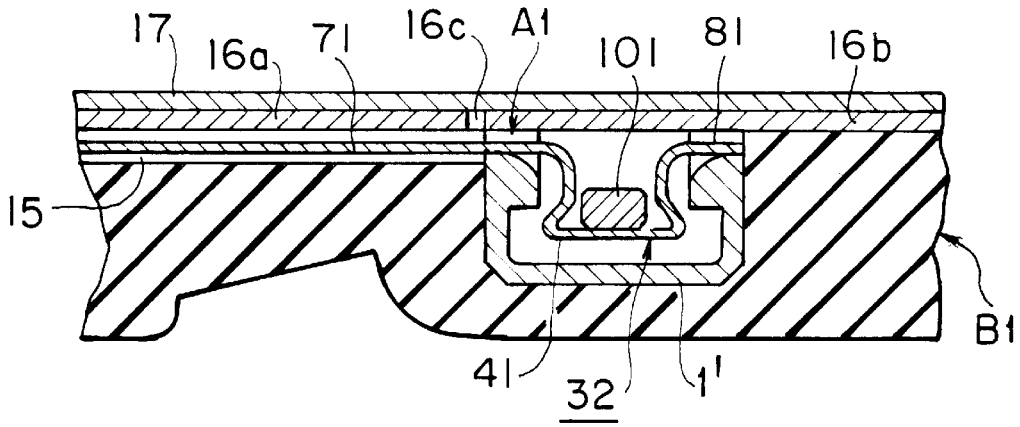
FIG. 22A is an enlarged side view at the ordinary time of a fourth embodiment according to the present invention.
Figure 22B:
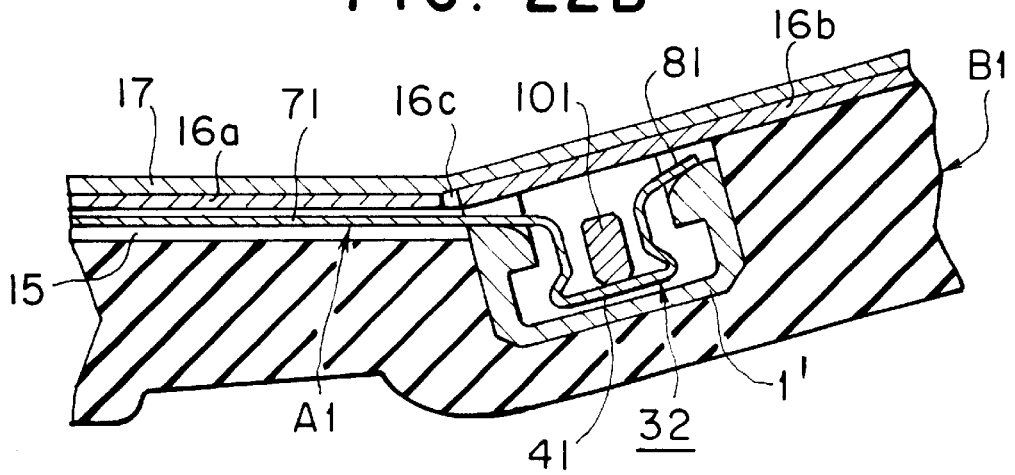
FIG. 22B is an enlarged longitudinal sectional side view when a cushion-action is applied of the fourth embodiment according to the present invention.

FIGS. 22A and 22B are respectively enlarged sectional views showing a fourth embodiment of the present invention. Even if a plate spring 32 with the embedded portion 81 on the heel side shortened is used, the cushioning effect similar to the above-described embodiment may be obtained.

In the fourth embodiment, constitution is made so that both the embedded portions 71 and 81 are moved. When the cam 101 is rotated to press the lower surface internally of the triangular flexing portion 41 is pressed downward, the whole plate spring 32 assumes a V-state, and the footwear bottom body B1 assumes a V-state, and the cushioning caused by the plate spring 32 is applied.

It is noted that in the gutter-like receiver 1' used in the third embodiment and the present embodiment, the inner bosom is made wide because when the cam 101 is operated, deformation of the flexing portion 41 may be carried out smoothly without being placed in contact with the inner surface of the gutter-like receiver 1'.

Figure 23:
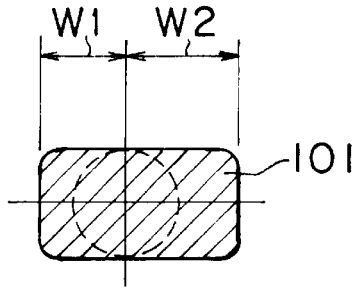
FIG. 23 is an enlarged sectional view showing another embodiment of the switching shaft.

FIG. 23 shows another embodiment of the cam 101. In the third and fourth embodiments, there are two kinds W1 and W2 of the projecting lengths of the cam 101 so that the angle of the plate spring 32 may be changed in two stages. Thereby, the switching shaft 91 may be rotated to switch the V-state deformation angle of the plate spring 32 in two stages.

Fifth Embodiment

Figure 24A:
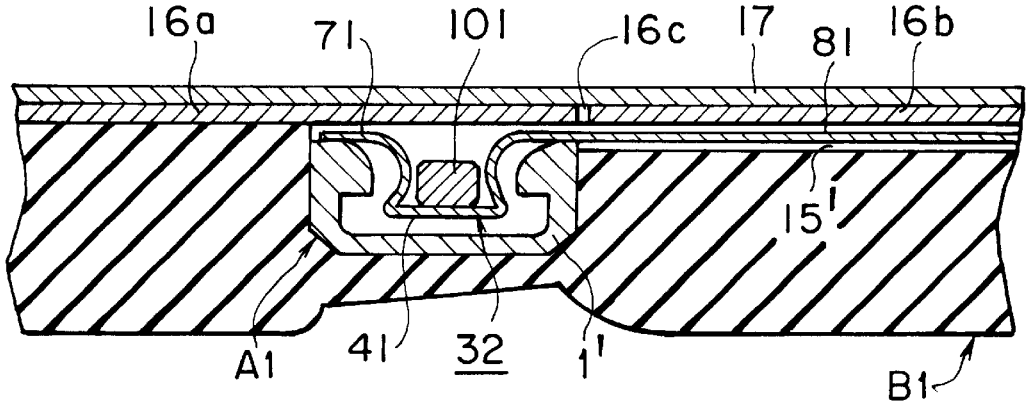
FIG. 24A is an enlarged longitudinal sectional side view at the ordinary time of a fifth embodiment according to the present invention.
Figure 24B:
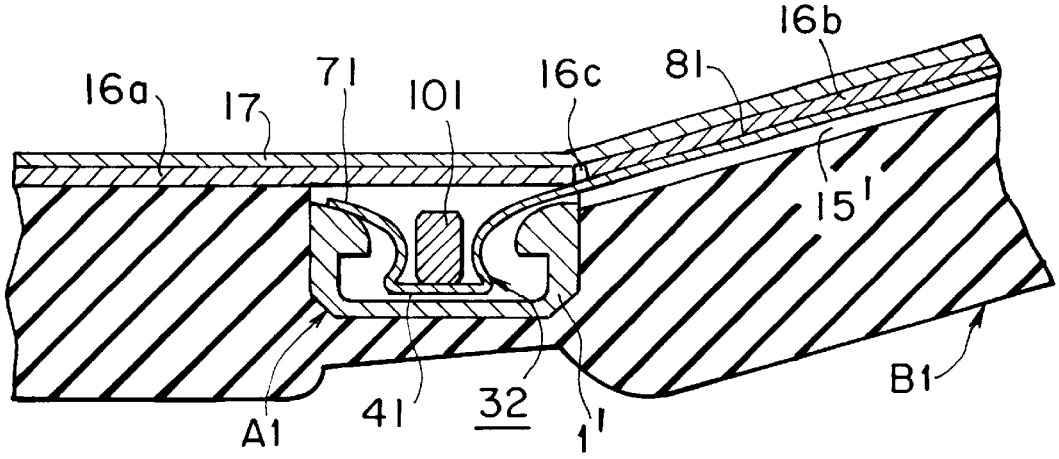
FIG. 24B is an enlarged longitudinal sectional side view when a cushion-action is applied of the fifth embodiment according to the present invention.

FIGS. 24A and 24B is an enlarged sectional view of a fifth embodiment. In the fourth embodiment shown in FIGS. 22A and 22B, the embedded portion 71 on the arch side is made long, and the embedded portion 81 on the heel side is made short, but in the fifth embodiment, conversely, the embedded portion 71 on the arch side is made short, and the embedded portion 81 on the heel side is made long.

Even if the lengths of the embedded portions are reversed as described above, by rotating the cam 101, the angle formed between the embedded portion 71 and the embedded portion 81 is changed to be horizontal as in FIG. 24A and to be V-shape as in FIG. 24B, respectively, to enable applying the cushioning to the footwear bottom body B1, similarly to the fourth embodiment.

Sixth Embodiment

Figure 25A:
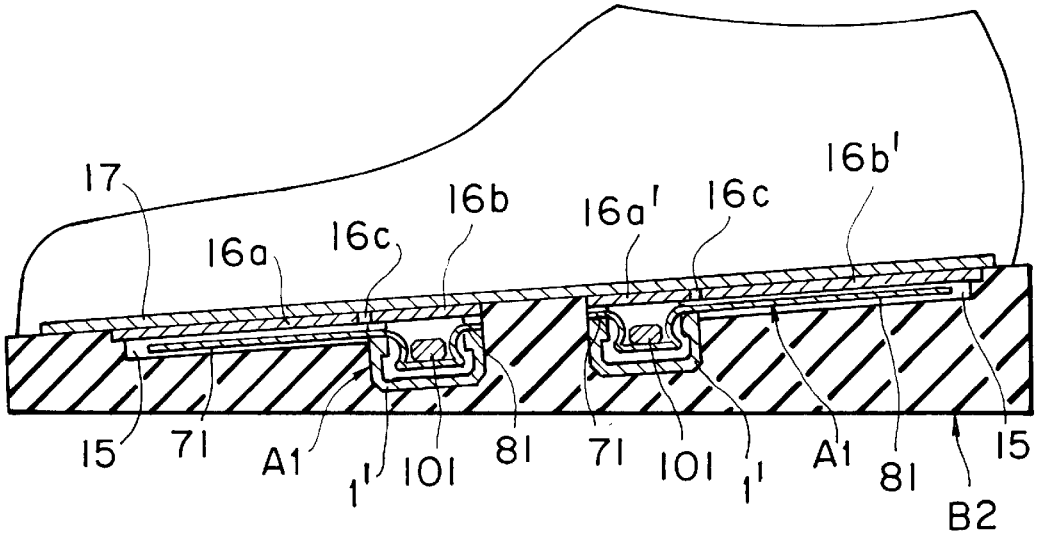
FIG. 25A is an enlarged longitudinal sectional side view at the ordinary time of a sixth embodiment according to the present invention.
Figure 25B:
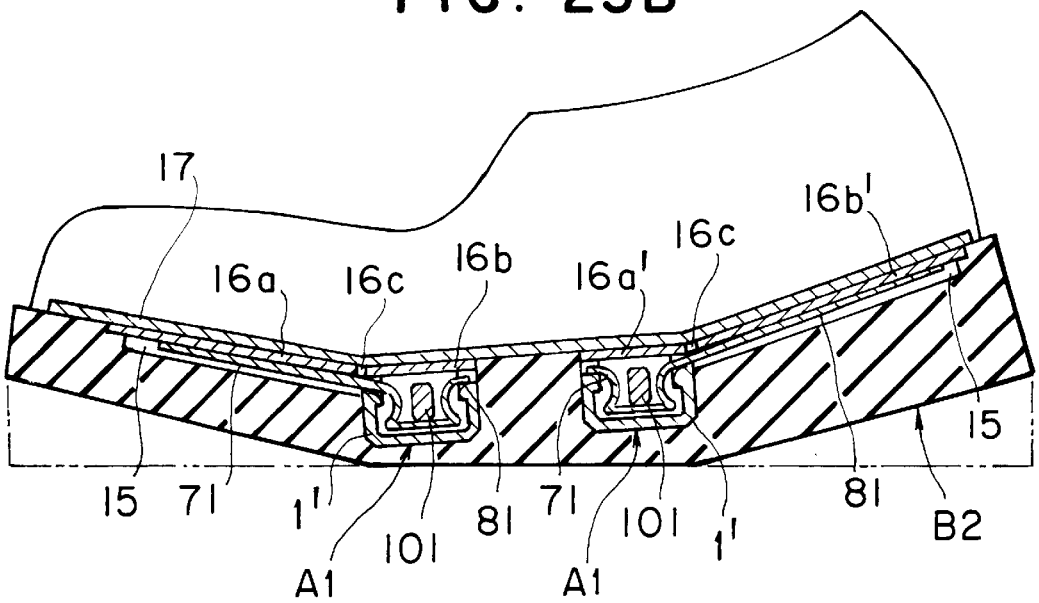
FIG. 25B is an enlarged longitudinal sectional side view when a cushion-action is applied of the sixth embodiment according to the present invention.

FIGS. 25A and 25B shows a sixth embodiment in which a plurality of cushion-action applying implements A1 are embedded in the footwear bottom B2. FIGS. 25A and 25B show a state that the cushion-action applying implements A1, A1 are nearly in horizontal, and a state that the cam 101 is rotated to place the cushion-action applying implements A1, A1 in a V-state, respectively.

In the state shown in FIG. 25B, the imposition of weight on the heel at the time of walking and running acts so that in the cushion-action applying implement on the heel side, the shock imposed on the foot, Achilles' tendon, knee joint and the like is alleviated by the cushion action caused by the upward force, and walking is done rhythmically and smoothly by the force in the direction of toe tips. Similarly, in the cushion-action applying implement of toe tips, there is an effect that when the weight is imposed on the toe tips, the cushioning caused by the upward force and the force in the direction of the toe tips occur to assist walking. Further, the footwear bottom according to the present invention is used for sports which require jumping such as volleyball, basketball or the like to thereby enable obtaining the high jumping force by the upward cushioning, and enable alleviating the shock imposed on feet at the time of landing. Furthermore, when there are a plurality of spots to which cushioning is applied, it is possible to freely combine the presence and absence of cushioning, adjusting to a walking, exercise or taste.

As will be apparent from the above-described inventions, according to the present invention, there can be provided a footwear free from feeling of fatigue in walking for a long period of time, and can be provided a footwear capable of simply switching to the state that there is no cushioning, that could have not been contemplated heretofore in the devices of this kind.

What is claimed is:

1. A footwear bottom characterized in that a cushion-action applying implement comprising a gutter-like receiver, a plate spring having a flexing portion inserted into the gutter-like portion, the flexing portion provided on both its sides with embedded portions in series, and an angle formed by the embedded portions being V or nearly horizontal, a switching shaft provided with a cam for pushing the flexing portion of the plate spring to change the angle formed by the embedded portions and in which an engaging portion for rotation is provided on the end thereof, a bearing of the switching shaft fixedly mounted on both ends of the gutter-like receiver, and a drive means for rotating the switching shaft embedded in a flexing portion of the footwear bottom body.

2. The footwear bottom according to claim 1, wherein one or both embedded portions is (are) embedded movably.

3. A cushion-action applying implement comprising a gutter-like receiver, a plate spring having a flexing portion is inserted into the gutter-like portion, the flexing portion being provided on both its sides with embedded portions in series, an angle formed by the embedded portions being V or nearly horizontal, a switching shaft provided with a cam for pushing the flexing portion of the plate spring to change the angle formed by the embedded portions and in which an engaging portion for rotation is provided on the end thereof, a bearing of the switching shaft fixedly mounted on both ends of the gutter-like receiver, and a drive means for rotating the switching shaft.

4. The cushion-action applying implement according to claim 3, wherein an embedded fixing plate is provided externally of the gutter-like receiver, and the flexing portion of the plate spring is in the form of a reversed Ω.

5. The cushion-action applying implement according to claim 3, wherein the flexing portion of the plate spring is in the form of a triangular shape.

* * * * *

UNITED STATES PATENT AND TRADEMARK OFFICE

CERTIFICATE OF CORRECTION

PATENT NO. : 6,718,655 B2
DATED : April 13, 2004
INVENTOR(S) : Fumio Sugawara

It is certified that error appears in the above-identified patent and that said Letters Patent is hereby corrected as shown below:

Title page,
Item [76], Inventor, change "Higashi-Iwai-Ken, Iwate-Gun" to -- Higashi-Iwai-Gun, Iwate-Ken --.

Signed and Sealed this

Tenth Day of August, 2004

JON W. DUDAS
*Acting Director of the United States Patent and Trademark Office*